US012478892B2

(12) United States Patent
Murphy

(10) Patent No.: US 12,478,892 B2
(45) **Date of Patent: *Nov. 25, 2025**

(54) SENSORIAL ACTIVITY TOYS

(71) Applicant: Pushpeel LLC, Albany, NY (US)

(72) Inventor: Sayer Murphy, East Aurora, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/947,172

(22) Filed: Nov. 14, 2024

(65) Prior Publication Data

US 2025/0288918 A1 Sep. 18, 2025

Related U.S. Application Data

(63) Continuation of application No. 18/604,422, filed on Mar. 13, 2024.

(51) Int. Cl.
*A63H 33/06* (2006.01)

(52) U.S. Cl.
CPC ..... *A63H 33/062* (2013.01)

(58) Field of Classification Search
CPC .. A63H 33/062; A63H 33/065; A63H 33/067; A63H 33/08; A63H 33/082; A63H 33/084; A63H 44/086; A63H 33/101
USPC ..... 472/85, 120–122, 124–125, 127; 446/105, 107, 108, 111, 113, 116, 118, 446/119, 124, 127, 491
See application file for complete search history.

(56) References Cited

U.S. PATENT DOCUMENTS 3,413,752 A * 12/1968 Perry ..... F16B 5/0008 24/DIG. 38
3,745,694 A * 7/1973 Vennola ..... A63H 33/00 446/124
3,792,866 A 2/1974 Dreyer et al.
(Continued)

FOREIGN PATENT DOCUMENTS

CN 202427148 U 9/2012
EP 0247097 A1 12/1987
(Continued)

OTHER PUBLICATIONS

U.S. Pat. No. 616,765, Issued Dec. 27, 1898, Brann, Oscar B., Kind Code: A; Entire document.

*Primary Examiner* — Joseph B Baldori
(74) *Attorney, Agent, or Firm* — Mertzlufft Law PLLC dba Stake; Joshua Mertzlufft

(57) ABSTRACT

A toy may include a platform including a surface, a channel defined by: the surface of the platform, a protrusion, including: a first protrusion segment extending from the surface of the platform, the first protrusion segment having a first distal edge segment disposed a protrusion distance from the surface of the platform; and a second protrusion segment extending from the surface of the platform, the second protrusion segment having a second distal edge segment, wherein the second distal edge segment is disposed the protrusion distance from the surface of the platform, wherein the platform and the protrusion are monolithic. A toy may include a removable member having a cross-sectional profile
(Continued)

having a circumdiameter larger than a separation distance between the first distal edge segment and the second distal edge segment such that the removable member is configured for insertion into the channel to form a snap fit therebetween.

23 Claims, 13 Drawing Sheets

(56) References Cited

U.S. PATENT DOCUMENTS 3,975,858 A * 8/1976 Much ..... A63H 33/102 446/124
4,035,977 A * 7/1977 Fischer ..... A63H 33/105 52/653.1
4,302,900 A * 12/1981 Rayner ..... A63H 33/062 446/120
D265,103 S 6/1982 Kroll
4,526,372 A 7/1985 Kikis
4,540,375 A * 9/1985 Fogarty ..... A63H 33/22 242/395
4,676,762 A * 6/1987 Ballard ..... A63H 33/105 446/124
5,174,757 A 12/1992 Jones
5,314,192 A 5/1994 Broudy et al.
5,372,450 A * 12/1994 Blodgett ..... A63H 33/10 D8/382
5,653,621 A * 8/1997 Yao ..... A63H 33/082 446/128
5,704,177 A * 1/1998 Wirkus ..... E04C 1/42 52/307
5,800,239 A * 9/1998 Cohen ..... A63H 33/105 446/124
5,826,873 A * 10/1998 Lavermicocca ..... B26F 3/12 273/157 R
5,916,006 A * 6/1999 Ganson ..... A63H 33/00 446/107
5,957,744 A * 9/1999 Mott ..... A63H 33/105 446/122
6,296,541 B1 * 10/2001 Bezalel ..... B65D 81/361 220/23.6
6,450,853 B1 * 9/2002 Larws ..... A63H 33/101 446/124
6,461,215 B1 * 10/2002 Kunz ..... A63H 33/042 446/124
6,669,526 B2 * 12/2003 Manville ..... A63H 33/101 446/113
6,676,474 B2 * 1/2004 Glickman ..... A63H 33/062 446/124
8,201,370 B1 * 6/2012 Goodwin ..... E04B 2/46 52/592.6
8,435,095 B1 * 5/2013 Abbas ..... A63H 33/105 446/122
8,920,206 B1 * 12/2014 Bartow ..... A63H 33/082 441/129
9,067,129 B2 6/2015 Encina Cusi
9,174,142 B2 * 11/2015 Lee ..... G09B 1/30
9,242,184 B1 * 1/2016 Mosquera ..... A63H 33/082
9,808,733 B2 * 11/2017 Lambert ..... A63H 33/082
9,914,067 B2 * 3/2018 Sufer ..... A63H 33/046
10,603,951 B2 * 3/2020 Skinner ..... A63H 33/00
10,843,099 B1 * 11/2020 Pratt ..... A63H 33/105
11,110,340 B1 * 9/2021 Emricson ..... A63F 3/00261
2004/0121699 A1 * 6/2004 Ladner ..... A63H 33/082 446/85
2007/0178799 A1 * 8/2007 Rudell ..... A63H 33/101 446/120
2008/0224399 A1 9/2008 Schambelan
2013/0000089 A1 * 1/2013 Lee ..... G09B 1/30 24/593.1
2017/0043272 A1 * 2/2017 Weiss ..... A63H 33/062
2017/0056782 A1 * 3/2017 Farco ..... A63H 33/103
2018/0154246 A1 6/2018 Moon
2023/0027454 A1 * 1/2023 Zhang ..... A63H 33/084
2023/0182001 A1 6/2023 Everett
2023/0330555 A1 * 10/2023 Jun ..... A63H 33/086
2024/0360632 A1 * 10/2024 Mettler ..... A63H 33/082

FOREIGN PATENT DOCUMENTS

GB 2163357 A 2/1986
KR 20170008108 A 1/2017
KR 102230675 B1 3/2021

* cited by examiner

SENSORIAL ACTIVITY TOYS

CROSS REFERENCE TO RELATED APPLICATIONS

This application is a continuation of U.S. application Ser. No. 18/604,422, filed on Mar. 13, 2024, the entire disclosure of which is hereby incorporated by reference.

BACKGROUND

Toy products may include fidget toys, brain teasers, parental aids, activity boards, puzzles, stress relievers, and fine motor skill development tools. Novel toys aim to address diverse needs within a single, comprehensive solution, catering to both children and adults alike. Such toy products may perform functions related both to play, to development, to enhance focus, and more.

SUMMARY

This Summary is intended to introduce, in an abbreviated form, various topics to be elaborated upon below in the Detailed Description. This Summary is not intended to identify key or essential aspects of the claimed invention. This Summary is similarly not intended for use as an aid in determining the scope of the claims.

In some aspects, the techniques described herein relate to a toy, including: a platform including a surface and extending therefrom a first protrusion including a first sidewall and a second protrusion including a second sidewall; and a flexible slender removable member having a thickness such that the flexible slender removable member is disposable at least partially within a channel formed by the surface, the first sidewall, and the second sidewall.

In some aspects, the techniques described herein relate to a toy, wherein a first channel width between the first sidewall and the second sidewall is larger than a second channel width between the first sidewall and the second sidewall, and wherein the second channel width is further from the surface than the first channel width.

In some aspects, the techniques described herein relate to a toy, wherein the flexible slender removable member has a cross-sectional profile having a circumdiameter larger than the second channel width such that the flexible slender removable member is configured for insertion into the channel to form a snap fit therebetween.

In some aspects, the techniques described herein relate to a toy, wherein the cross-sectional profile is elliptical, circular, or polygonal.

In some aspects, the techniques described herein relate to a toy, wherein the first sidewall is concave with respect to the first protrusion and the second sidewall is concave with respect to the second protrusion.

In some aspects, the techniques described herein relate to a toy, wherein the first sidewall is at least partially arcuate and the second sidewall is at least partially arcuate.

In some aspects, the techniques described herein relate to a toy, wherein the surface is planar.

In some aspects, the techniques described herein relate to a toy, wherein the surface is cylindrical.

In some aspects, the techniques described herein relate to a toy, wherein the surface is polyhedral or spherical.

In some aspects, the techniques described herein relate to a toy, wherein the first sidewall is axially symmetric about a longitudinal axis of the first protrusion.

In some aspects, the techniques described herein relate to a toy, further including a rigid back plate having the platform disposed thereon.

In some aspects, the techniques described herein relate to a toy, wherein the platform includes an interconnect configured to connect the platform with a further platform of a further toy.

In some aspects, the techniques described herein relate to a toy, wherein the interconnect is further configured to connect the platform with the further platform such that the flexible slender removable member is disposable simultaneously within the channel and a further channel of the further toy.

In some aspects, the techniques described herein relate to a toy, wherein the interconnect includes an interlocking geometric feature of the platform.

In some aspects, the techniques described herein relate to a toy, wherein the interconnect includes a tether.

In some aspects, the techniques described herein relate to a toy, wherein the flexible slender removable member includes silicone.

In some aspects, the techniques described herein relate to a toy, wherein the platform is prismatic.

In some aspects, the techniques described herein relate to a toy, wherein the platform includes an opening to a cavity defined by the platform.

In some aspects, the techniques described herein relate to a toy, further including a cap configured to attach to the platform to close the opening.

In some aspects, the techniques described herein relate to a toy, including: a platform including a surface and extending therefrom a first protrusion including a first sidewall and a second protrusion including a second sidewall, wherein a first channel width between the first sidewall and the second sidewall is larger than a second channel width between the first sidewall and the second sidewall, and wherein the second channel width is further from the surface than the first channel width; and a flexible slender removable member having a thickness such that the flexible slender removable member is disposable at least partially within a channel formed by the surface, the first sidewall, and the second sidewall, wherein the flexible slender removable member has a cross-sectional profile having a circumdiameter larger than the second channel width such that the flexible slender removable member is configured for insertion into the channel to form a snap fit therebetween.

BRIEF DESCRIPTION OF THE FIGURES

For a fuller understanding of the nature and objects of the disclosure, reference should be made to the following detailed description taken in conjunction with the accompanying drawings, in which.

DETAILED DESCRIPTION

Figure 1A:
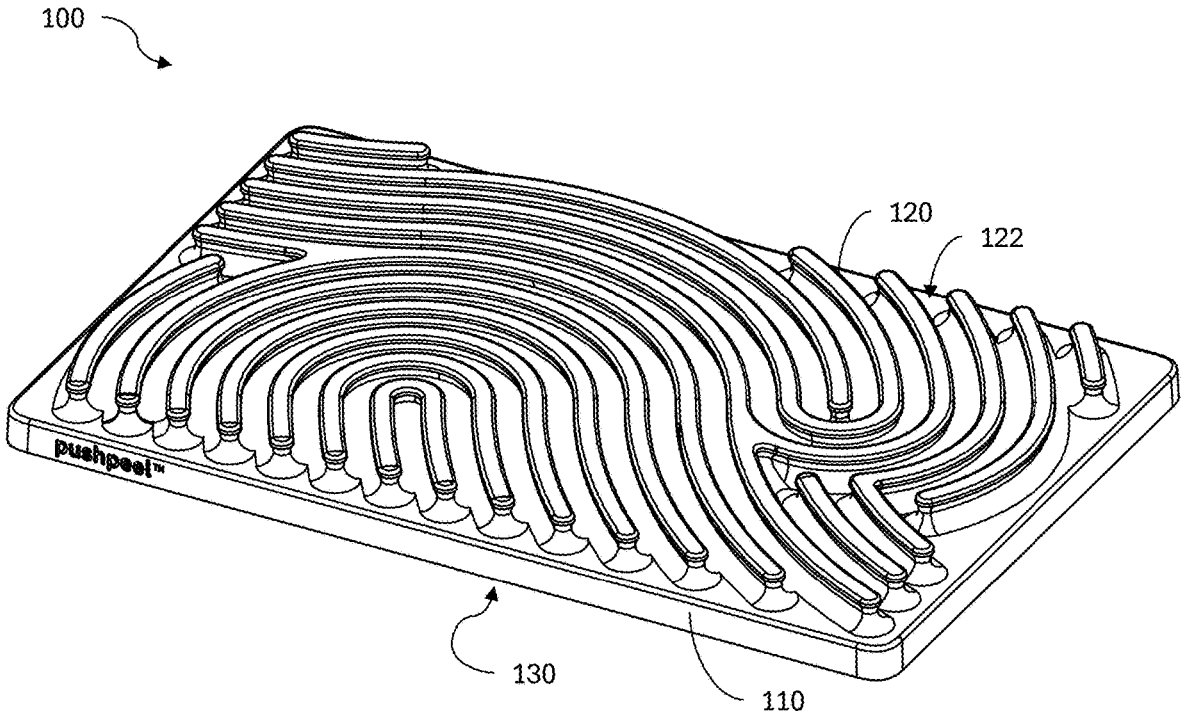
FIG. 1A illustrates a toy, according to one or more implementations herein.

Implementations disclosed herein include sensorial activity toys and methods of using the same, which provide a tactile activities to children and adult users. Such sensorial activity toys may be quiet, easy to transport, and provide for creative engagement of the user's motor skills.

Implementations may offer users a holistic experience, engaging their senses through tactile, and visual stimuli while simultaneously challenging cognitive abilities and promoting relaxation. The intricate design of such toys incorporates diverse textures, shapes, and resistance, providing a comprehensive platform for skill enhancement and sensory exploration.

A conventional fidget toy, such a spinner or a popping toy, operates by providing a physical outlet for restless energy or nervous tension through repetitive movements or tactile sensations, typically in the form of small handheld objects. By offering a means to engage one's hands and senses, a fidget toy addresses the need for sensory stimulation and cognitive focus, aiding individuals in managing stress, improving concentration, and enhancing fine motor skills. Fidget toys like spinners or popits often produce clicking, popping, or snapping sounds that can disrupt those nearby. Furthermore, their repetitive nature and lack of creative opportunity may lead to diminished appeal over time, limiting their entertainment value and longevity for users seeking more engaging activities.

Conventional puzzles offer mental stimulation, problem-solving challenges, and a sense of accomplishment upon completion. They engage individuals of all ages in critical thinking, spatial reasoning, and cognitive development, fostering patience and perseverance. However, conventional puzzles may lack versatility in accommodating various skill levels and interests, potentially leading to boredom or frustration for users seeking more dynamic or customizable experiences. Furthermore, puzzles lack a tactile reward experience, limiting engagement for users seeking more hands-on or multisensory stimulation.

Such conventional toys do not include a product that seamlessly integrates these disparate functionalities into a single, cohesive product, this new hybrid toy category represents a significant advancement in the field of play therapy, parental assistance, developmental aid, and recreational activities.

Implementations disclosed herein include sensorial activity toys and methods of using the same. Such sensorial activity toys may include a platform and protrusions defining one or more channels.

From the user's perspective, implementations may provide various advantages over conventional products. Implementations may provide a mesmerizing Autonomous Sensory Meridian Response (ASMR) quality, engaging the senses with visual and tactile sensations. Completing the toy by properly seating each removable element may offer a user a profound sense of achievement, bolstering confidence and encouraging further exploration. Implementations may foster problem-solving skills and intellectual stimulation through an intricate puzzle-like challenge, promoting cognitive development and critical thinking abilities.

Implementations may further aid in concentration and patience, serving as a calming outlet for stress relief while simultaneously developing spatial reasoning and fine motor skills. Implementations may offer a constructive outlet for restless energy and sparks creativity through interactive play. Implementations may provide a valuable reprieve by engaging their children's attention in a quiet, non-messy, safe, and non-distracting activity, offering moments of tranquility whether out to eat, in a waiting room, in a car/plane or at home.

FIG. 1A illustrates a toy 100, according to one or more implementations herein. The toy 100 may provide users of various ages and developmental statuses with a safe, quiet, stimulating, and engaging activity.

The toy 100 may include a platform 110 and one or more protrusions 120, which may alternatively be referred to herein as the protrusions 120 or be collectively referred to as the protrusion 120.

One or more protrusions 120 may extend from the platform 110, for example, perpendicular to the platform. The protrusions and the platform may be monolithic.

In some implementations, the platform 110 and the protrusions 120 may not be monolithic. In this instance one protrusion 120 or neither may be monolithic with the platform 110 in either a rigid or deformable material. While the other protrusion 120 may be co-molded, overmolded or assembled to the platform 110 in either a similar or dissimilar, rigid, or deformable material. This partial or non-monolithic variation may offer a decorative or utilitarian purpose. A decorative purpose would include but not limited to color variation between protrusions 120 and platform 110, whereas the utilitarian purpose could be, but not limited two, dissimilar protrusion 120 material providing the deformable property to accept the removable elements, and the platform 110 providing the rigidity, eliminating the need for an additional rigid back plate.

The protrusions 120 and the platform 110 may define one or more channels 122. Each channel 122 may be defined by the platform 110 and the protrusion 120, each protrusion having a distal edge including a distal edge segment. Each protrusion 120 may extend a protrusion distance from the surface of the platform 110.

For example, a portion of the channel 122 may be defined by a first protrusion 120 and a second protrusion 120, or between segments of a single protrusion 120. The first protrusion 120 may have a first distal edge segment and the second protrusion 120 may have a second distal edge segment.

The first distal edge segment and the second distal edge segment may be separated by varying distances over their protrusion elevation from the platform 110 to enable a snap fit with a removable member. As such, the first distal edge segment and the second distal edge segment may be separated by a separation distance. The separation distance may include a reference to a distance between the two closest points, or a local minimum, separation distance between the first distal edge segment and the second distal edge segment). This separation distance may be less than a circumdiameter of a cross-sectional profile of the removable member.

In some implementations, the first distal edge segment and the second distal edge segment are parallel. In some implementations, the first distal edge segment and the second distal edge segment are concentric. It will be understood that some segments of the first distal edge and second distal edge may be parallel, and others may be concentric or otherwise follow a path such that each edge is substantially equidistant from the path.

One or more channels 122, delineated by the platform 110 and protrusions 120, may be arranged in diverse patterns to accommodate numerous elastic, plastic, or rigid removable elements. Users may place removable elements directly within the specified channels or adopt a more imaginative approach by looping, bridging, or traversing over the channels along alternative dimensional axes not prescribed by the channels 122 themselves.

The channels 122 may be configured such that the distance between the distal edges of the protrusions is smaller than the circumdiameter of a cross-sectional profile of the removable member. In this arrangement, either the platform 110, the protrusions 120, or the removable member can deform, resulting in a slight transitory resistance during the seating process of the removable element. This feature demands an appropriate level of attention and motor skills from the user, instilling confidence in the secure positional alignment of the slender elements with the platform, while offering the user a satisfying sensorial experience with a fidget like play quality. In some implementations, the sensorial activity toy 100 may further include a rigid back plate 130.

The platform 110 may have a surface. The surface may be, for example, planar, cylindrical, cubic, spherical, or of another shape based on the geometry of the platform.

In some implementations, the platform 110 may have a planar surface terminated in varying shapes, including various polygons, non-polygons, irregular shapes, branded shapes, or themed shapes. This planar surface may thus be placed on various working surfaces. It will also be understood that the toy 100 can be of varying sizes, ranging from a size operable by a single user up to sizes providing for the interaction of multiple users.

Figure 1B:
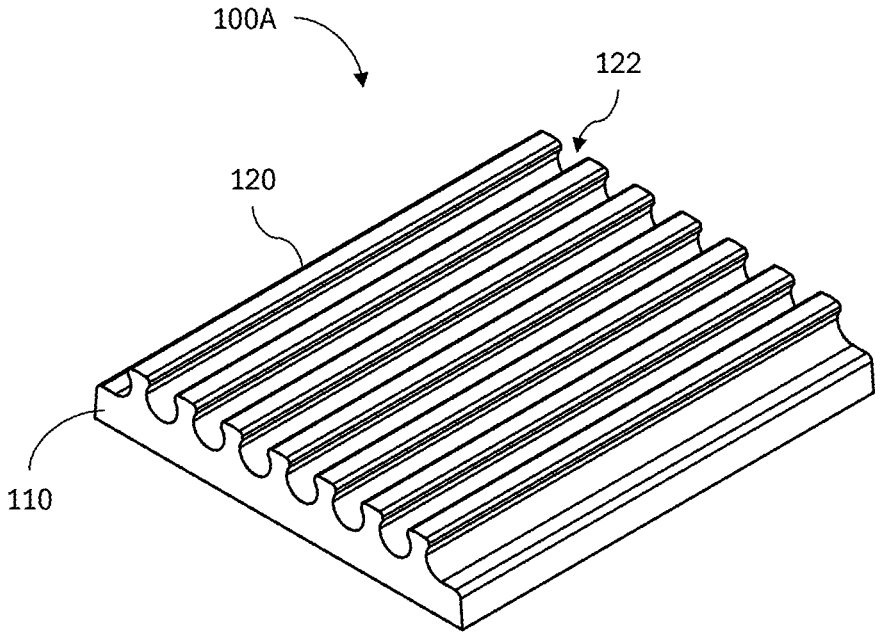
FIG. 1B illustrates an isometric view of a detailed section of a toy, according to one or more implementations herein.

FIG. 1B illustrates an isometric view of a detailed section 100A of a toy, according to one or more implementations herein. The detailed section 100A of the toy may illustrate the definition of the channel 122 by the platform 110 and the protrusion(s) 120.

Figure 1C:
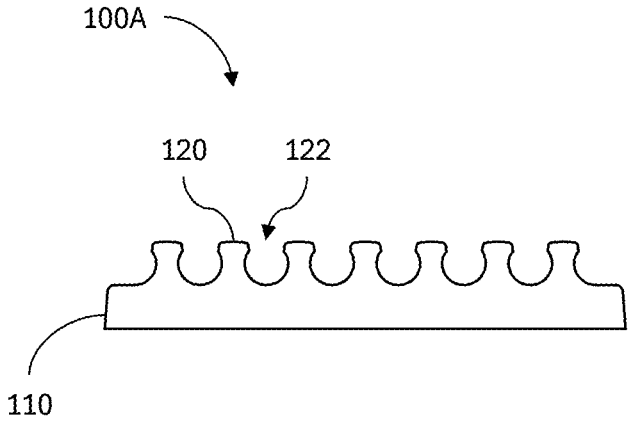
FIG. 1C illustrates a side view of a detailed section of a toy, according to one or more implementations herein.

FIG. 1C illustrates a side view of a detailed section 100A of a toy, according to one or more implementations herein. The detailed section 100A of the toy may further illustrate the definition of the channel 122 by the platform 110 and the protrusion(s) 120.

Figure 1D:
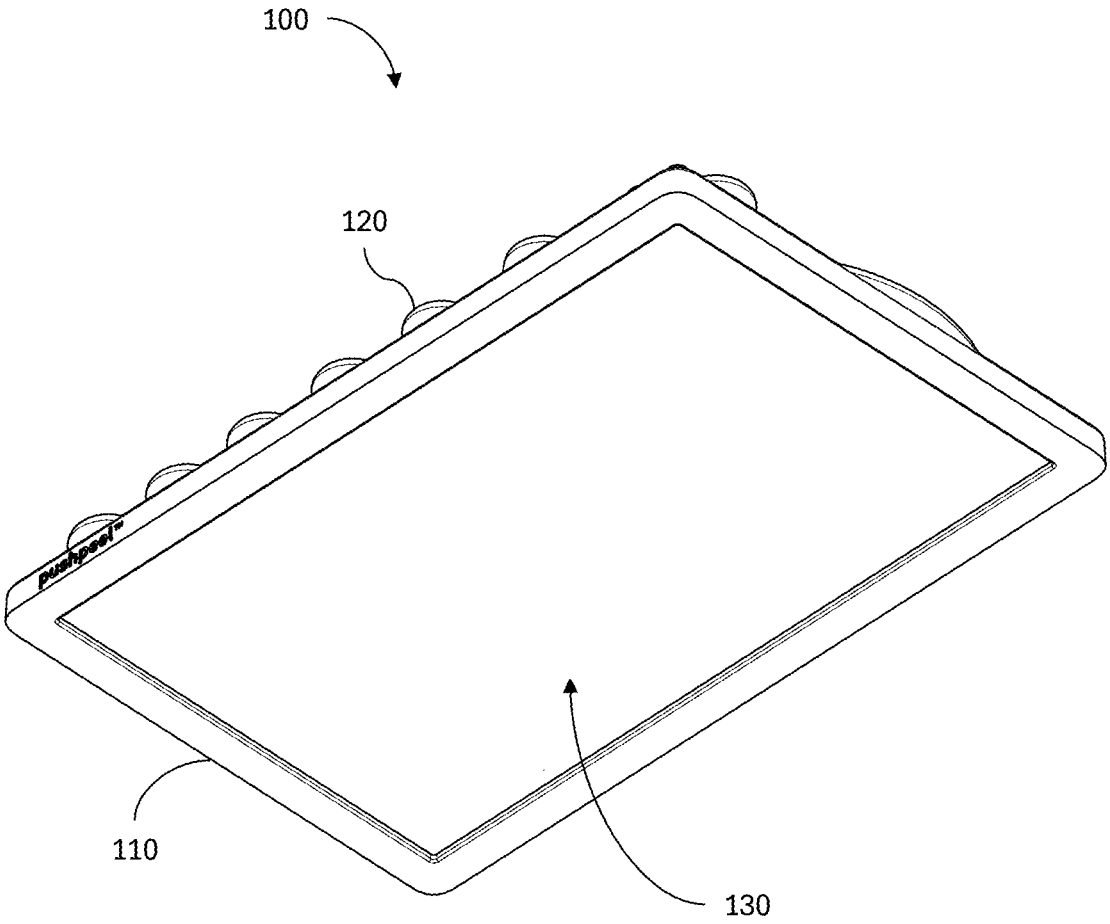
FIG. 1D illustrates a further isometric view of a toy, according to one or more implementations herein.

FIG. 1D illustrates a further isometric view of the toy 100, according to one or more implementations herein. FIG. 1D illustrates implementations including a rigid back plate 130. The platform 110 may be disposed on the rigid back plate 130. For example, the platform 110 and protrusions 120 may be a flexible material (e.g., silicone) while the rigid back plate 130 may be a rigid or semi-rigid material (e.g., a rigid polymer or a semi-rigid polymer). In this way, the platform 110 and protrusions 120 may be monolithic such that the protrusions 120 are able to elastically deform, while the platform 110 is prevented from flexing due to its attachment to the rigid back plate 130. The rigid back plate 130 may thus enable the toy to be placed on an uneven or non-rigid surface while the platform maintains shape, thus preventing the removable members from unintentionally unseating.

Figure 1E:
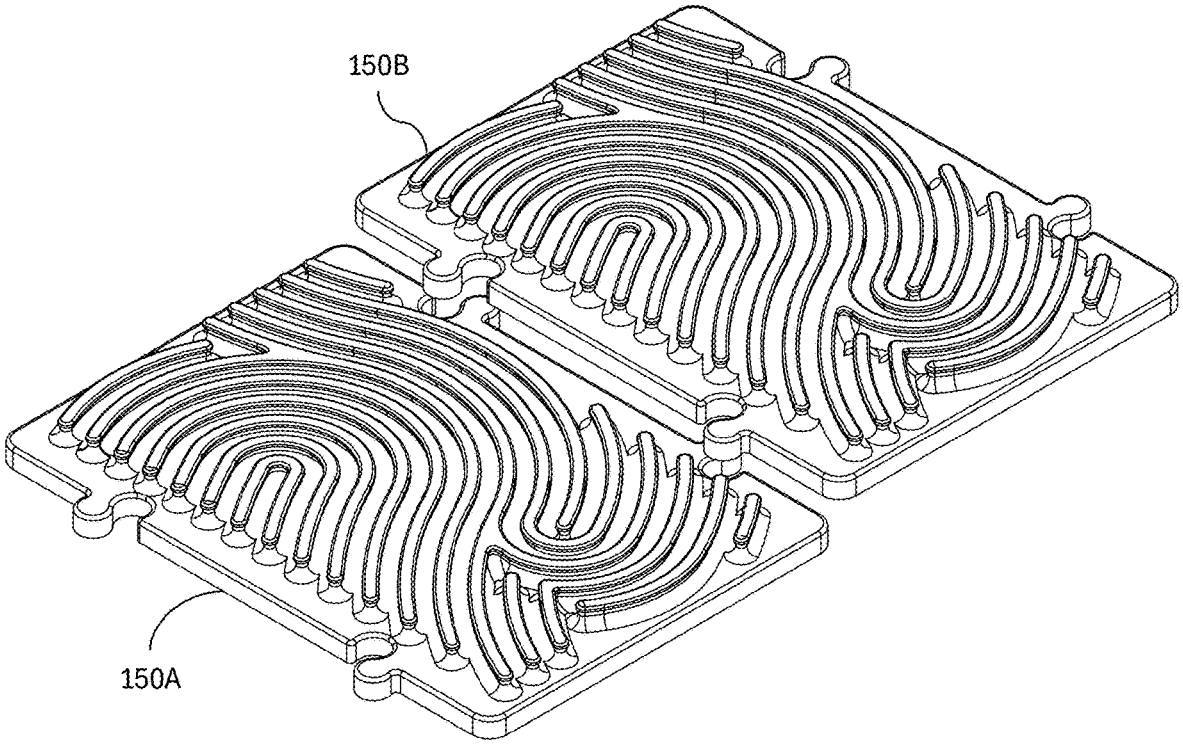
FIG. 1E illustrates a group of interlocking toys, according to one or more implementations herein.

FIG. 1E illustrates a group of interlocking toys 150A and 150B, according to one or more implementations herein. Each of the interlocking toys 150A and 150B may share some or all of the aspects of toy 100 as described herein. In some implementations, multiple planar platforms of the interlocking toys 150A and 150B can be planarly placed adjacent each other, either freely or through a connecting feature. This may expand the field of play and offers another level of interest.

Figure 2:
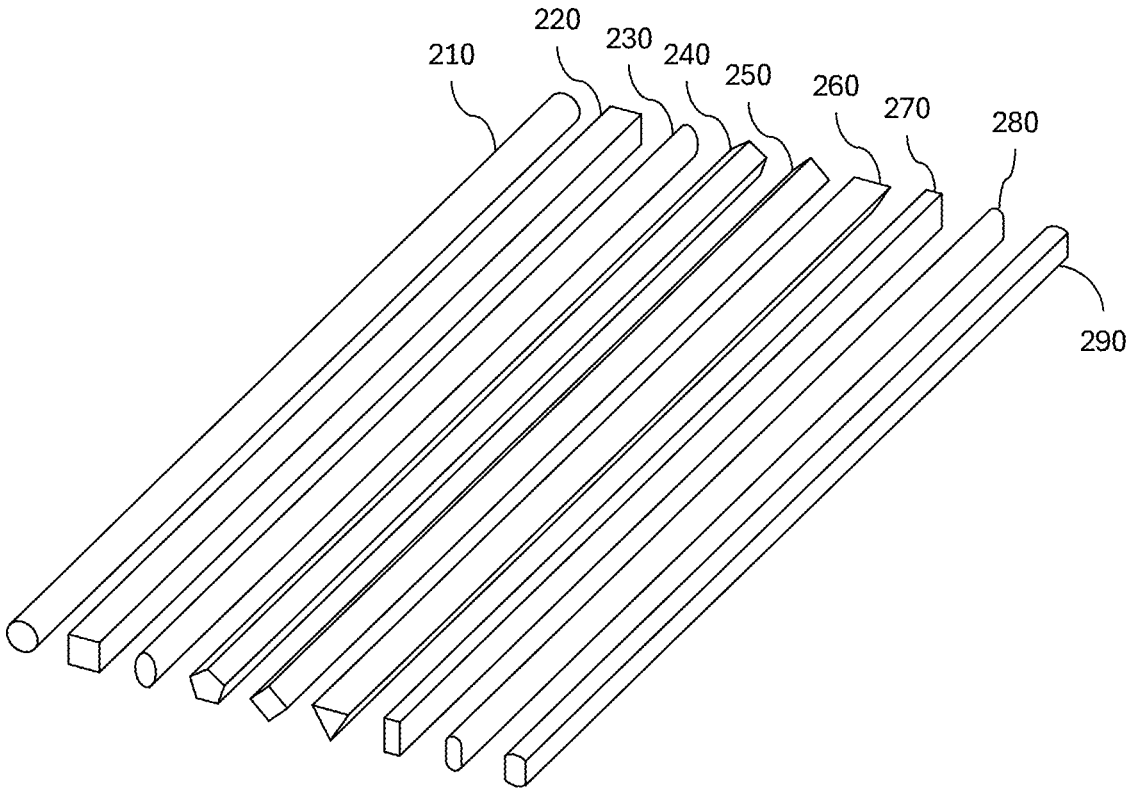
FIG. 2 illustrates various examples of removable members, according to one or more implementations herein.

FIG. 2 illustrates various examples of removable members, according to one or more implementations herein.

A sensorial activity toy may include at least one removable member. The removable member may have a cross-sectional profile. The cross-sectional profile may be, for example, elliptical (e.g., circular, or non-circular) or polygonal (e.g., triangular, rectangular, square, pentagonal, hexagonal, octagonal, another number of sides greater than three, or an irregular polygon). The cross-sectional profile may be understood to have a circumdiameter, which is the diameter of the circle circumscribing the cross-sectional profile.

An example removable member 210 may have a circular profile. An example removable member 220 may have a square profile. An example removable member 230 may have an elliptical profile. An example removable member 240 may have a pentagonal profile. An example removable member 250 may have a diamond profile. An example removable member 260 may have a triangular profile. An example removable member 270 may have a rectangular profile. An example removable member 280 may have an oval profile. An example removable member 290 may have an irregular profile. References herein made to the removable member 210 may be understood to include alternatively the removable members 220, 230, 240, 250, 260, 270, 280, 290, and other shapes of removable members as will be readily understood.

The circumdiameter of the cross-sectional profile of the removable member 210 may be such that, when the removable member 210 is inserted into the channel (e.g., the channel 122), a fit is established between the portion of the removable member 210 within the channel and the channel walls (e.g., the platform 110 and protrusions 120). The fit may be, for example, a clearance fit, a transition fit, or an interference fit. Removable members may be of varying lengths, groups of lengths, or the same lengths.

In some implementations of the protrusions the circumdiameter of the cross-sectional profile of the removable member 210 may be such that, when the removable member 210 is inserted into the channel, an interference fit, dependent on deformation of either the removable member 210, platform, or channel, is maintained by the channel defined by the protrusion spacing being consistently smaller than the circumdiameter of the removable member 210 along the entire length of the protrusion distance. Unlike a snap fit where resistance required to seat the removable member 210 passes through an interference fit before the resistance dissipates. In an interference fit, the resistance required to seat the removable member 210 remains constant, increases (assuming friction holds it seated) or reduces without completely dissipating as it translates through or is inserted into a channel.

In some implementations, the removable member 210 is slender and deformable. In such implementations, the removable member 210 can be elastically deformed to conform to the shape defined by the channel and held in place by a snap or interference fit. Once the removable member 210 is removed it may return to its original shape.

In some implementations, the removable member 210 is laterally plastically deformable. In such implementations, the removable member 210 can be plastically deformed to conform to the shape defined by the channel and held in place by a snap or interference fit. Once the removable member 210 is removed it may maintain its assumed shape until further manipulation.

In some implementations, the removable member 210 can be deformed either plastically or elastically localized outside of the channel to form loops, bridge, or other shapes supported on either side by the channel or terminated outside a channel. A twist in the removable member 210 may be maintained, for example, by the interference between the removable member 210 and the channels to deform the member into a loop.

In some implementations, the removable member 210 includes a rigid rod. In some implementations, the removable member may be rigid (e.g., non-deformable) and the snap or interference fit may be imparted by, for example deformable protrusions and or platform. The channel's shape, as defined by the protrusions, may either directly correspond to the rigid removable member 210 or would elastically or plastically deform for the removable member 210 to be securely seated.

In some implementations, the platform and protrusions are monolithic and rigid. The removable member 210 may be elastically or plastically deformable and could assume the shape of various rigidly defined channels.

In some implementations, the cross-sectional profile of the removable member 210 may change over the length of the removable member 210. For example, the cross-sectional profile may be elliptical or circular over one segment, polygonal in another, and transition therebetween.

Figure 3:
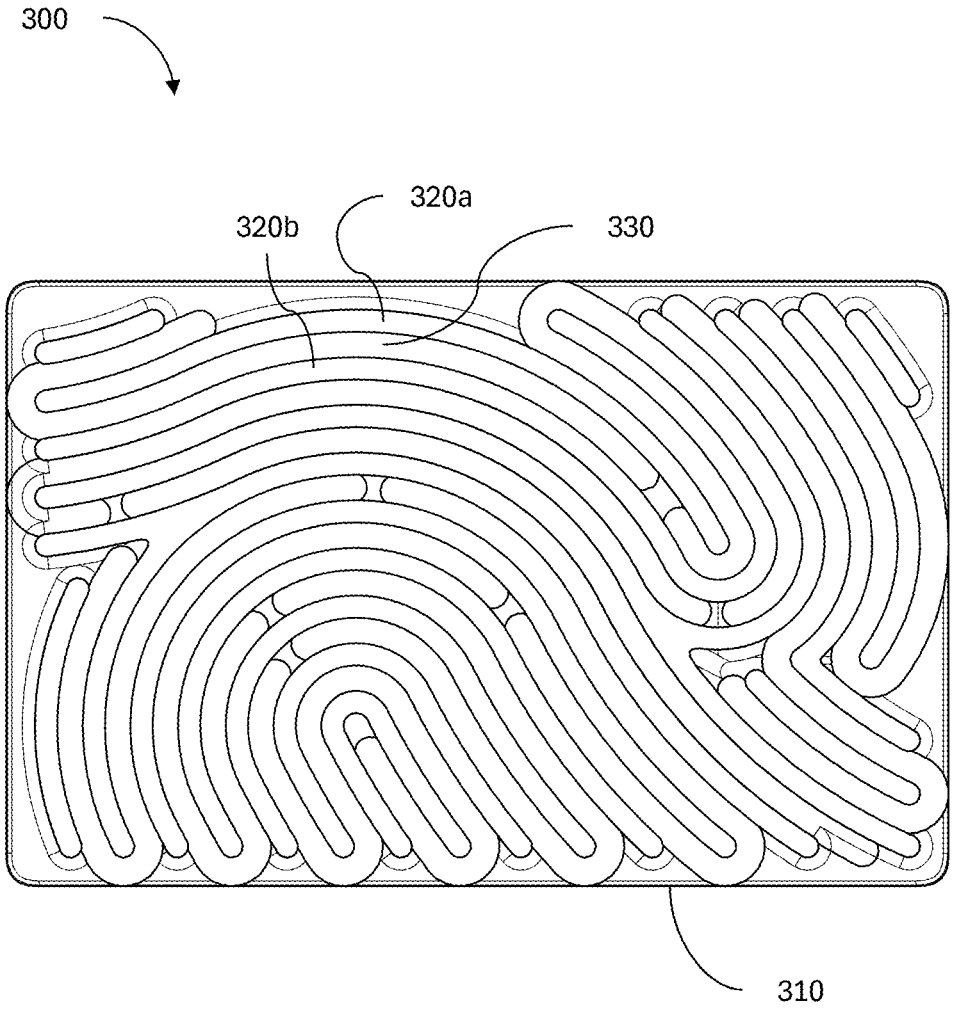
FIG. 3 illustrates a toy having removable members attached thereto, according to one or more implementations herein.

FIG. 3 illustrates a toy 300 having removable members 330 attached thereto, according to one or more implementations herein.

The circumdiameter of the cross-sectional profile of the removable member 330 may be such that, when the removable member 330 is inserted into the channel (e.g., between segments 320*a* and 320*b* of a protrusion and the platform 310), a fit is established between the portion of the removable member 330 within the channel and the channel wall (e.g., the platform 310 and protrusion segments 320*a* and 320*b*). The fit may be, for example, a clearance fit, a transition fit, or an interference fit.

In some implementations, the circumdiameter of the cross-sectional profile of the removable member 330 may be such that, when the removable member 330 is inserted into the channel, an interference fit, dependent on deformation of either the removable member 330, platform 310, or channel, is maintained by the channel defined by the protrusion spacing (e.g., the spacing between the distal edges of segments 320*a* and 320*b*) being consistently smaller than the circumdiameter of the removable member 330 along the entire length of the protrusion distance. Unlike a snap fit where resistance required to seat the removable member 330 passes through an interference fit before the resistance dissipates. In an interference fit, the resistance required to seat the removable member 330 remains constant, increases (assuming friction holds it seated), or reduces without completely dissipating as it translates through or is inserted into a channel.

Figure 4:
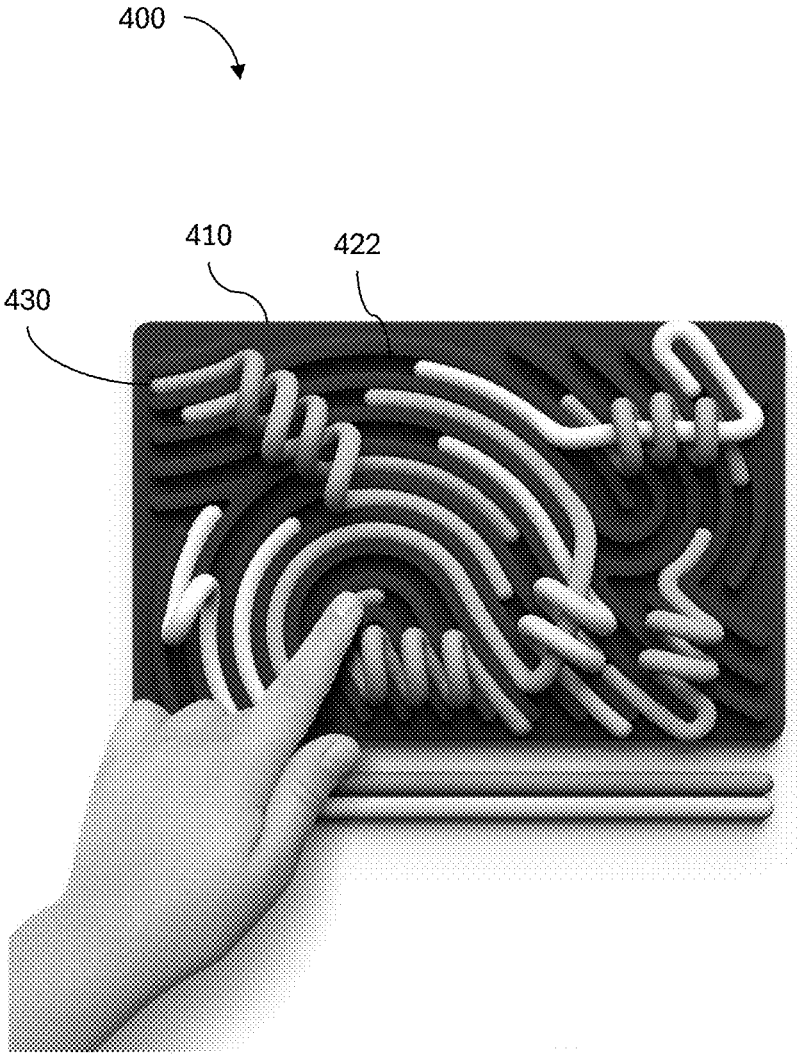
FIG. 4 illustrates a toy having elastic removable members, according to one or more implementations herein.

FIG. 4 illustrates a toy 400 having elastic removable members 430, according to one or more implementations herein. The removable members 430, being elastic, may provide for an additional dimension of play using the toy 400. In such implementations, the removable member 430 can be deformed either plastically or elastically localized outside of a channel 422 to form loops, bridge, or other shapes supported on either side by the channel 422 or terminated outside a channel 422. A twist in the removable member 430 may be maintained, for example, by the interference between the removable member 430 and the channels 422 to deform the member into a loop.

In use, the removable member 430 may be inserted and removed from a channel 422 of the toy 400. The user may be provided a single or multitude of removable members 430, similar or dissimilar (e.g., various lengths, or colors). The variations may be strategically or randomly determined. The removable members 430 may be securely placed in the channels 422 of the platform 410 with creative focus, as an outlet for restless energy, or with the goal to fill every channel. The intentional resistance when seated may offer a user a satisfying tactile experience.

Unlike a puzzle where each element's orientation is predetermined, and unlike a doodle board with a blank slate, implementations may provide a balance between customization and guided play.

The act of inserting a member with precision and intentionality may be juxtaposed to the act of removing or peeling away the removable member. The removal process may in some implementations require little fine motor skill, or accuracy, for example, a gentle controlled pull separates the member from the platform in what, for some users may be an experience just as relevant to the play value as the insertion.

Figure 5:
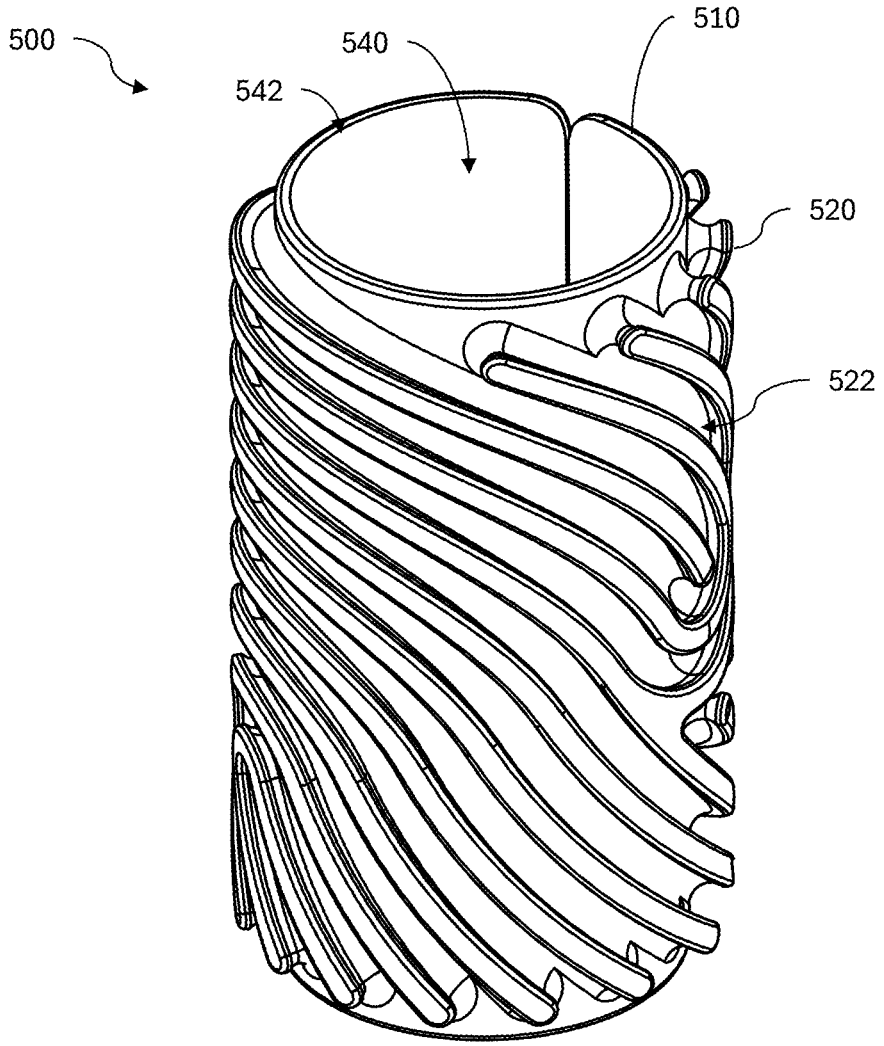
FIG. 5 illustrates a toy having a cylindrically shaped platform, according to one or more implementations herein.

FIG. 5 illustrates a toy 500 having a cylindrically shaped platform 510, according to one or more implementations herein. As such, the platform 510 may have a cylindrical surface, accompanied by corresponding protrusions 520 defining channels 522 that may fully wrap around the centralized axis in a loop. In some implementations, multiple cylindrical platforms 510 could be axially stacked or snapped together to scale the play value.

In some implementations, the removable members can be stored within a hollowed volume defined by a cavity 540 corresponding to the platform surface (e.g., inside a spherical, polyhedron, cylindrical platform). The cavity 540 may be accessible by an opening 542 to the cavity 540. Storage of removable members within such a hollowed volume may utilize an access point. The access point may be left open, covered with a removable lid, or a lid connected with a living hinge. The lid may have protrusions on the exterior to define channels or be left without protrusions.

Figure 6:
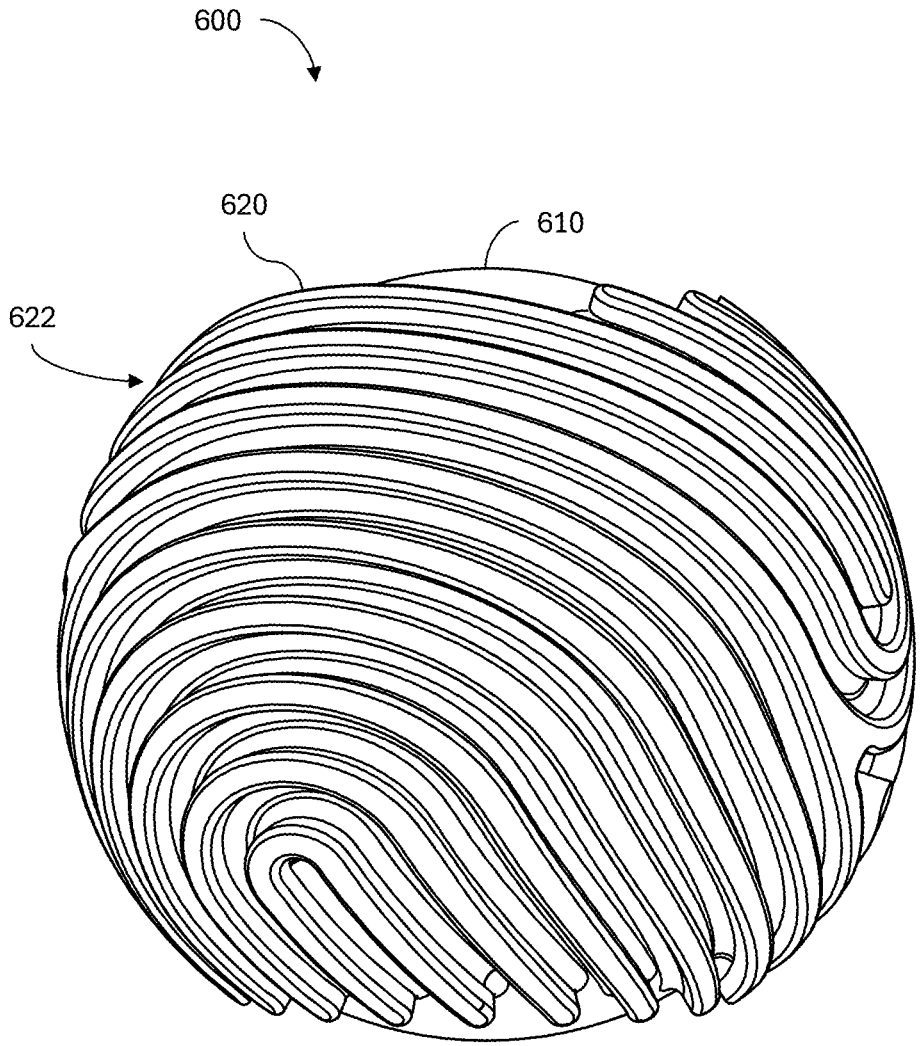
FIG. 6 illustrates a toy having a spherically shaped platform, according to one or more implementations herein.

FIG. 6 illustrates a toy 600 having a spherically shaped platform 610, according to one or more implementations herein. As such, the platform 610 may have a spherical surface, accompanied by corresponding protrusions 620 defining channels 622, for example, to allow the user to rotate the object exposing more channels without a defined start, stop, top or bottom.

Figure 7:
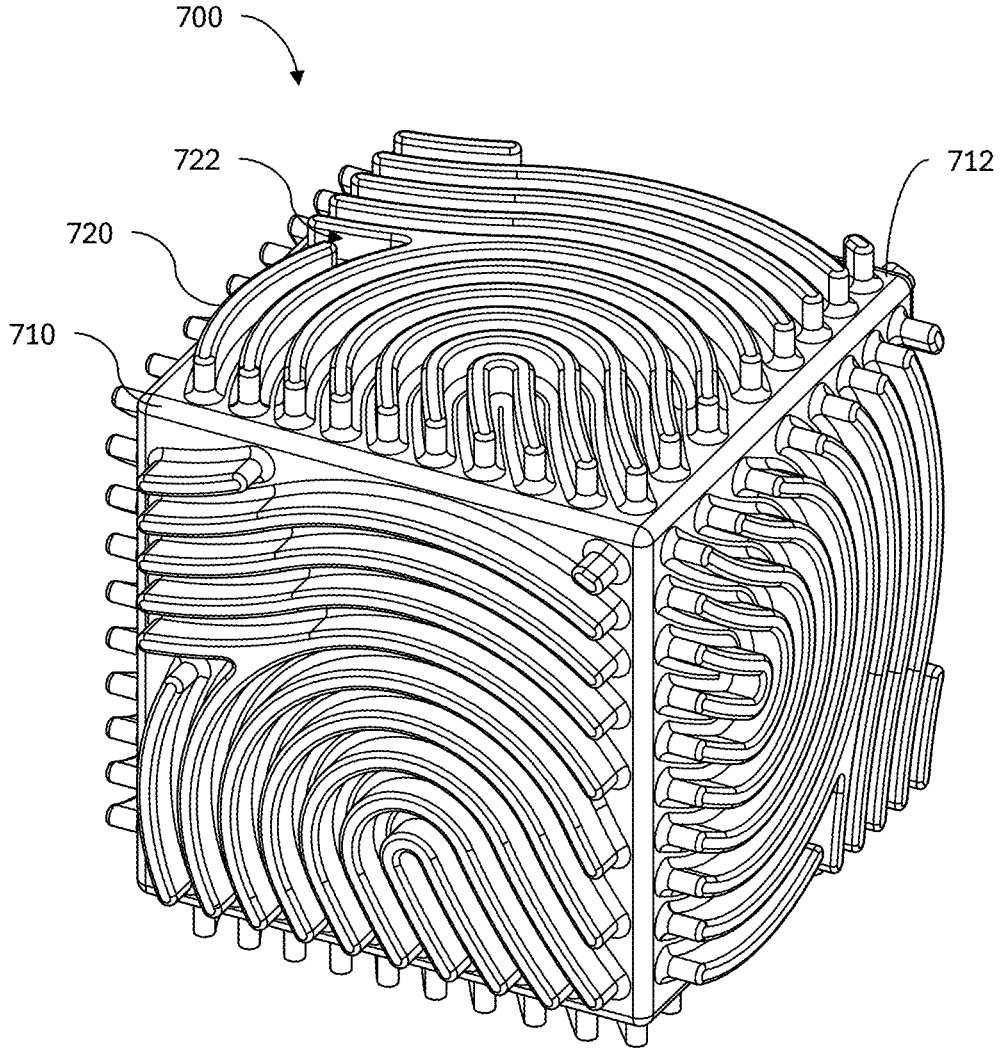
FIG. 7 illustrates a toy having a polyhedron-shaped platform, according to one or more implementations herein.

FIG. 7 illustrates a toy 700 having a polyhedron-shaped platform 710, according to one or more implementations herein. As such, the platform 710 may have surfaces defining a polyhedron (e.g., tetrahedron, cubic, octahedron, another number of planar surfaces greater than four, or an irregular polyhedron) and protrusions 720 extending therefrom defining channels 722. The central space within the three-dimensional (e.g., spherical, cylindrical, prismatic, etc.) platform may be hollow (e.g., a cavity similar to the cavity 540) to provide for storage of removable members or other elements. In such an implementation, a side of the polyhedron-shaped platform 710 may include a cap 712. The cap 712 may be configured to attach to the platform 710 to close an opening of the platform 710.

In other implementations, the platforms surface could have alternative three-dimensional shape that either defines a solid volume (e.g., capsule, toroidal, ellipsoid, kidney shape) or an irregular curved surface (e.g., hyperbolic paraboloid, Möbius strip, gyroid). For example, one of the sides of the platform may be openable or removable to access storage space inside.

In some implementations, the platform includes an interconnect configured to connect with a further platform of a further toy. Various platform shapes can be interconnected to expand channels and increase play optionality. The connection between platforms may be, for example, through an interlocking puzzle geometry, snap fit feature, or tether. For example, the platforms may be connected with a snap fit or interference fit feature. In one implementation, the platforms may be connected with one or multiple tether connectors. The tethers may be distinct tethers for the purpose of interconnecting platforms or in another implementation the removable member doubles as platform tethers.

Figure 8:
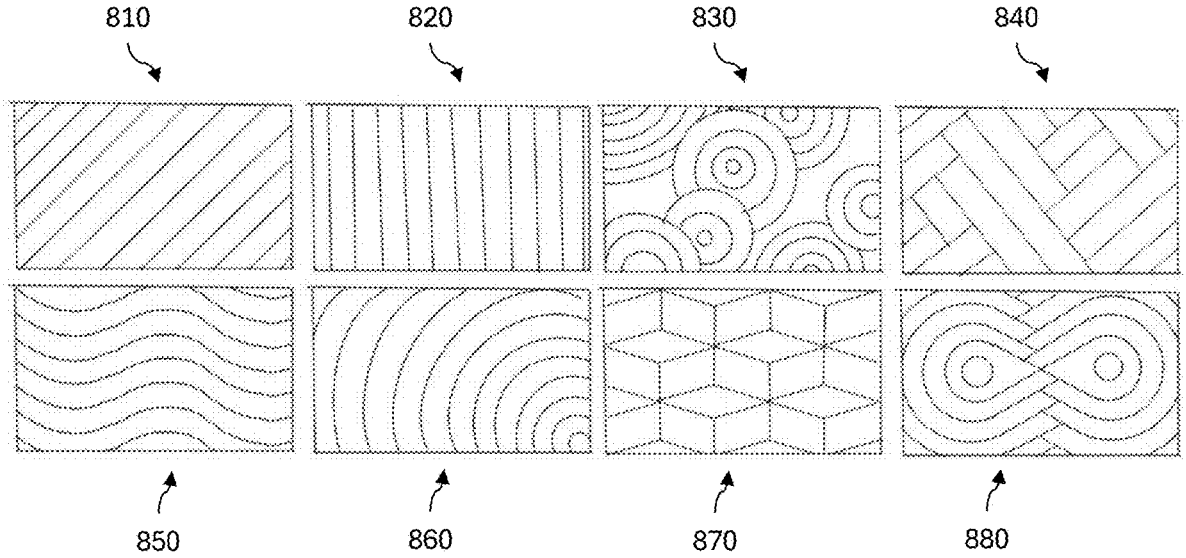
FIG. 8 illustrates various example channel path designs, which may be overlaid on varying platforms to define channels, according to one or more implementations herein.

FIG. 8 illustrates various example channel path designs, which may be overlaid on varying platforms to define channels, according to one or more implementations herein. An example channel path design 810 may include straight channels. An example channel path design 820 may include skewed channels. An example channel path design 830 may include circular channels. An example channel path design 840 may include cross-hatched channels. An example channel path design 850 may include wave channels. An example channel path design 860 may include spiral channels. An example channel path design 870 may include polygonal channels. An example channel path design 880 may include variously designed channels. For example, a channel path design may include channels designed to follow paths resembling various shapes and objects (e.g., owls, robots, branded shapes).

Figure 9:
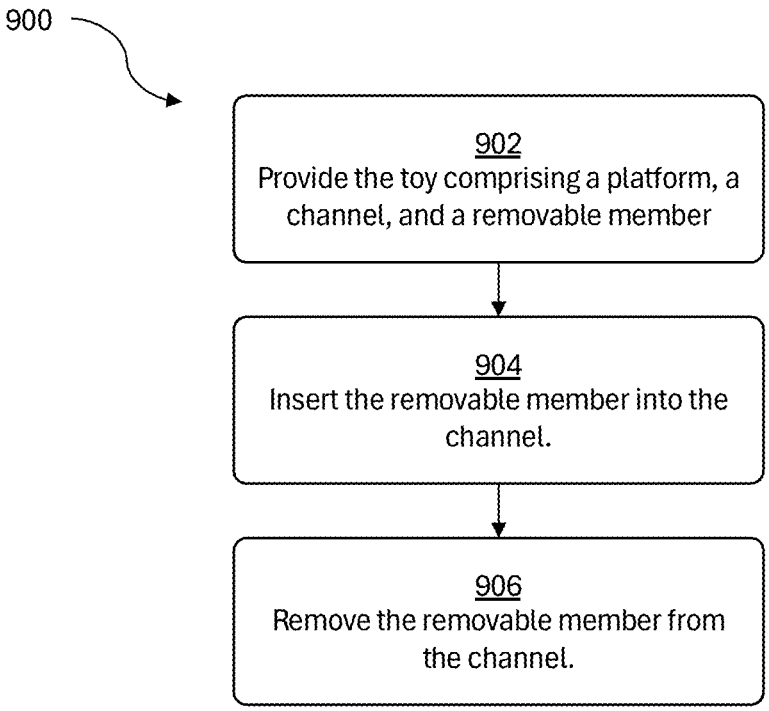
FIG. 9 is a flowchart of an example method for using a toy, according to one or more implementations herein.

FIG. 9 is a flowchart of an example method 900 for using a toy, according to one or more implementations herein. In some implementations, one or more operations may be performed using a toy as described in one or more of FIGS. 1A-8. In some implementations, one or more operations may be performed by another device or system, or group of devices or systems separate from or including these. Additionally, or alternatively other devices, components, or systems, may be employed to perform the operations.

At step 902, a toy may be provided. The toy may comprise: a platform including a surface, a channel defined by: the surface of the platform, a protrusion, including: a first protrusion segment extending from the surface of the platform, the first protrusion segment having a first distal edge segment disposed a protrusion distance from the surface of the platform; and a second protrusion segment extending from the surface of the platform, the second protrusion segment having a second distal edge segment, wherein the second distal edge segment is disposed the protrusion distance from the surface of the platform, wherein the platform, the first protrusion, and the second protrusion are monolithic; and a removable member having a cross-sectional profile having a circumdiameter larger than a separation distance between the first distal edge segment and the second distal edge segment such that the removable member is configured for insertion into the channel to form a snap fit therebetween.

At step 904, the removable member may be inserted into the channel to form the snap fit therebetween.

At step 906, the removable member may then be removed (e.g., extracted) from the channel.

Although FIG. 9 depicts example method 900 and operations thereof, in some implementations, a method illustrated herein may include additional operations, fewer operations, differently arranged operations, or different operations than the operations depicted in FIG. 9. Moreover, or in the alternative, two or more of the operations depicted in FIG. 9 may be performed at least partially in parallel.

Figure 10:
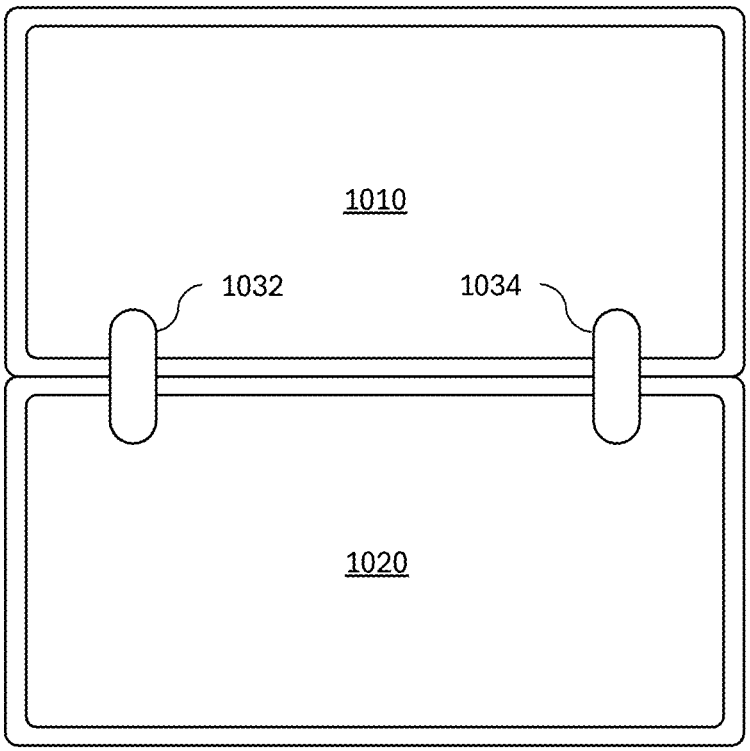
FIG. 10 illustrates an example of two platforms tethered together, according to one or more implementations herein.

FIG. 10 illustrates an example of two platforms 1010 and 1020 tethered together, according to one or more implementations herein. The platforms 1010 and 1020 may be connected by one or more tethers, for example, tethers 1032 and 1034, which may be distinct from the flexible slender removable members for the purpose of interconnecting platforms.

The invention is limited only by the appended claims. Variations, characteristics, advantages, implementations, constructions, arrangements, terminology, materials, dimensions, embodiments, illustrations, depictions, and examples composing the above description and accompanying drawings show some possible implementations of the invention without limiting the invention. It is not necessary that every implementation of the invention achieve or possess every advantage, purpose, or characteristic identified herein, and as such, one skilled in the art may effect various additions, changes, modifications, or omissions without departing from the scope or spirit of the invention or its legal equivalents.

All ranges are inclusive of the stated limits, the orders of magnitude thereof, and all values and ranges substantially therebetween unless otherwise defined. Unless otherwise stated, every use of "and" forms an inclusive list comprising at least the conjoined elements, and every use of "or" forms an inclusive list comprising at least one element of conjoined elements. Unless otherwise stated, singular usage (e.g., 'a', 'an', or 'the') includes plurals of the same.

The order of recitations in a claim do not imply a temporal or ordered relationship unless unavoidable by the plain language of that claim. No claim may be interpreted to invoke 35 U.S.C. § 112(f) unless that claim recites "means for" or "step for."

I claim:

1. A toy, comprising:

a platform defined by at least a surface, a first channel, and a second channel not rectilinearly parallel to the first channel, each of the first channel and the second channel including a first sidewall of a first protrusion extending from the surface and a second sidewall of a second protrusion extending from the surface, wherein optionally the first protrusion or the second protrusion of the first channel corresponds to one of the first protrusion or the second protrusion of the second channel; and a discrete flexible member being cylindrical along at least a partial length thereof and having a thickness such that a bulk of the discrete flexible member is releasably securable along the partial length thereof within the first channel or the second channel such that at least a portion of the discrete flexible member is curvilinear, wherein the discrete flexible member has a cross-sectional profile having a circumdiameter less than a length of the discrete flexible member.

2. The toy of claim 1, wherein a first channel width between the first sidewall and the second sidewall is larger than a second channel width between the first sidewall and the second sidewall, and wherein the second channel width is further from the surface than the first channel width.

3. The toy of claim 2, wherein the discrete flexible member has a cross-sectional profile having a circumdiameter larger than the second channel width such that the discrete flexible member is configured for insertion into the first channel or the second channel to form a snap fit therebetween.

4. The toy of claim 1, wherein the first sidewall is concave with respect to the first protrusion and the second sidewall is concave with respect to the second protrusion.

5. The toy of claim 1, wherein the first sidewall is at least partially arcuate and the second sidewall is at least partially arcuate.

6. The toy of claim 1, wherein the surface is planar.

7. The toy of claim 1, wherein the surface is cylindrical.

8. The toy of claim 1, wherein the surface is polyhedral or spherical.

9. The toy of claim 1, wherein the first sidewall is axially symmetric about a longitudinal axis of the first protrusion.

10. The toy of claim 1, further comprising a rigid back plate having the platform disposed thereon.

11. The toy of claim 1, wherein the platform includes an interconnect configured to connect the platform with a further platform of a further toy.

12. The toy of claim 11, wherein the interconnect is further configured to connect the platform with the further platform such that the discrete flexible member is disposable simultaneously within the first channel and a further channel of the further toy.

13. The toy of claim 11, wherein the interconnect comprises an interlocking geometric feature of the platform.

14. The toy of claim 11, wherein the interconnect comprises a tether.

15. The toy of claim 1, wherein the discrete flexible member comprises silicone.

16. The toy of claim 1, wherein the platform is polyhedron-shaped.

17. The toy of claim 16, wherein the platform includes an opening to a cavity defined by the platform.

18. The toy of claim 17, further comprising a cap configured to attach to the platform to close the opening.

19. The toy of claim 1, wherein a ratio of the circumdiameter to the length is less than 0.1.

20. A toy, comprising:

a platform defined by at least a surface, a first channel, and a second channel not rectilinearly parallel to the first channel, each of the first channel and the second channel including a first sidewall of a first protrusion extending from the surface and a second sidewall of a second protrusion extending from the surface, wherein optionally the first protrusion or the second protrusion of the first channel corresponds to one of the first protrusion or the second protrusion of the second channel, wherein a first channel width between the first sidewall and the second sidewall is larger than a second channel width between the first sidewall and the second sidewall, and wherein the second channel width is further from the surface than the first channel width; and a discrete flexible member being cylindrical along at least a partial length thereof and having a thickness such that a bulk of the discrete flexible member is releasably securable along the partial length thereof within the first channel or the second channel such that at least a portion of the discrete flexible member is curvilinear, wherein the discrete flexible member has a cross-sectional profile having a circumdiameter larger than the second channel width such that the discrete flexible member is configured for insertion into the first channel or the second channel to form a snap fit therebetween, and wherein the circumdiameter is less than a length of the discrete flexible member.

21. A toy, comprising:

a platform defined by at least a surface, a first channel, and a second channel, each of the first channel and the second channel being serpentine and including a first sidewall of a first protrusion extending from the surface and a second sidewall of a second protrusion extending from the surface, wherein optionally the first protrusion or the second protrusion of the first channel corresponds to one of the first protrusion or the second protrusion of the second channel; and a discrete flexible member being cylindrical along at least a partial length thereof and having a thickness such that a bulk of the discrete flexible member is releasably securable along the partial length thereof within the first channel or the second channel.

22. The toy of claim 21, wherein the discrete flexible member has a cross-sectional profile having a circumdiameter less than a length of the discrete flexible member.

23. The toy of claim 22, wherein a ratio of the circumdiameter to the length is less than 0.1.

* * * * *